US005620252A

United States Patent [19]

Maurer

[11] Patent Number: 5,620,252

[45] Date of Patent: Apr. 15, 1997

[54] STATIC MIXER APPARATUS FOR HIGHLY VISCOUS MEDIA

[75] Inventor: Rudolf Maurer, Winterthur, Switzerland

[73] Assignee: Sulzer Management AG, Switzerland

[21] Appl. No.: 585,817

[22] Filed: Jan. 16, 1996

[30] Foreign Application Priority Data

Feb. 2, 1995 [EP] European Pat. Off. ..... 95810073

[51] Int. Cl.[6] ..... B01F 5/06

[52] U.S. Cl. ..... 366/337

[58] Field of Search ..... 366/336, 337, 366/340; 138/40, 42; 48/189.4

[56] References Cited

U.S. PATENT DOCUMENTS

| | | | |
|---|---|---|---|
| 3,682,443 | 8/1972 | Upmeier | 366/336 |
| 3,942,765 | 3/1976 | Hendrickson | 366/336 |
| 4,062,524 | 12/1977 | Brauner . | |
| 4,211,277 | 7/1980 | Grosz-Roll et al. | 138/42 X |
| 4,220,416 | 9/1980 | Brauner et al. | 366/337 |
| 4,352,378 | 10/1982 | Bergmann et al. | 366/337 X |
| 4,692,030 | 9/1987 | Tauscher et al. | 366/336 X |

FOREIGN PATENT DOCUMENTS

| | | | |
|---|---|---|---|
| 0226879 | 7/1987 | European Pat. Off. . | |
| 2061746 | 5/1981 | United Kingdom | 366/336 |

*Primary Examiner*—Charles E. Cooley
*Attorney, Agent, or Firm*—Townsend and Townsend and Crew LLP

[57] ABSTRACT

The static mixer apparatus for highly viscous media comprises a pipe (2) and at least one mixer element (10) arranged in the pipe. The pipe defines a principal flow direction (4) of the medium to be mixed. The structure elements of the mixer element are substantially webs (3, 30) each forming an angle relative to the principal flow direction. The cross-section of the pipe is not completely covered over by the mixer element, namely such that two segment-shaped edge regions lying between the side edges of the lateral webs (3) of the mixer element and the pipe wall do not have any webs (30) arranged inclined relative to the principal flow direction. Reinforcing ribs are disclosed for the static mixing element, which ribs can optimally have an expanded center section to cooperate with the mixer in producing mixing of the highly viscous media.

8 Claims, 2 Drawing Sheets

STATIC MIXER APPARATUS FOR HIGHLY VISCOUS MEDIA

The invention relates to a static mixer apparatus for highly viscous media, in particular for plastic melts. The invention further relates to a mixer element of a mixer apparatus of this kind and to a use of this apparatus.

BACKGROUND OF THE INVENTION

An apparatus of this kind is known from the patent documents GB 2 061 746 (CA 1,177,061) or U.S. Pat. No. 4,211,277. The mixer element of this apparatus has a structure built up from webs which criss-cross each other and engage into one another wherein the webs form two groups of parallel structure elements.

A problem is caused by the webs which are arranged at the edge of the mixer element and contact the pipe wall at their outer edges or which at least lie in proximity thereto. More specifically, the medium to be mixed flows substantially more slowly in the region of these webs than in the inner region of the mixer element. In the corner region between the webs positioned at the edge and the pipe wall the medium thus has a relatively long dwell time which, as has been shown in practice, can lead to a drop in quality of the product produced from the mixed media.

SUMMARY OF THE INVENTION

A static mixing device for highly viscous media, includes a conduit in a static mixer. The conduit is a tubular casing defined about an axis of fluid flow for fluid to be mixed by the static mixer. At least one static mixer element is utilized, having first cross webs and second cross webs. Each cross web is disposed at a different angle other than normal with respect to the axis of fluid flow. The cross webs include individual spaced-apart linear web elements, defining fluid flow intervals therebetween. The individual spaced apart linear web elements of any crossed web extend substantially parallel to one another. The individual spaced apart linear web elements of the first cross webs angularly intersect, cross and occupy a portion of the flow intervals of the individual spaced apart linear web elements of the second cross webs. The individual spaced apart linear web elements have a border at their respective ends, to the tubular casing. No individual spaced apart linear web element has a border with the tubular casing continuously between their respective ends, so as to define a flow interval between the individual spaced apart linear web elements, and the tubular casing. Reinforcing ribs are provided instead of webs, positioned at the edge of the mixer elements. Expanded ribs are disclosed for both reinforcing the mixer elements and cooperating with the mixing and homogenizing of plastic melt passing through the static mixers.

BRIEF DESCRIPTION OF THE DRAWINGS

The invention is described in the following by means of example only with the aid of the drawing which shows.

DESCRIPTION OF THE PREFERRED EMBODIMENT

Figure 1:
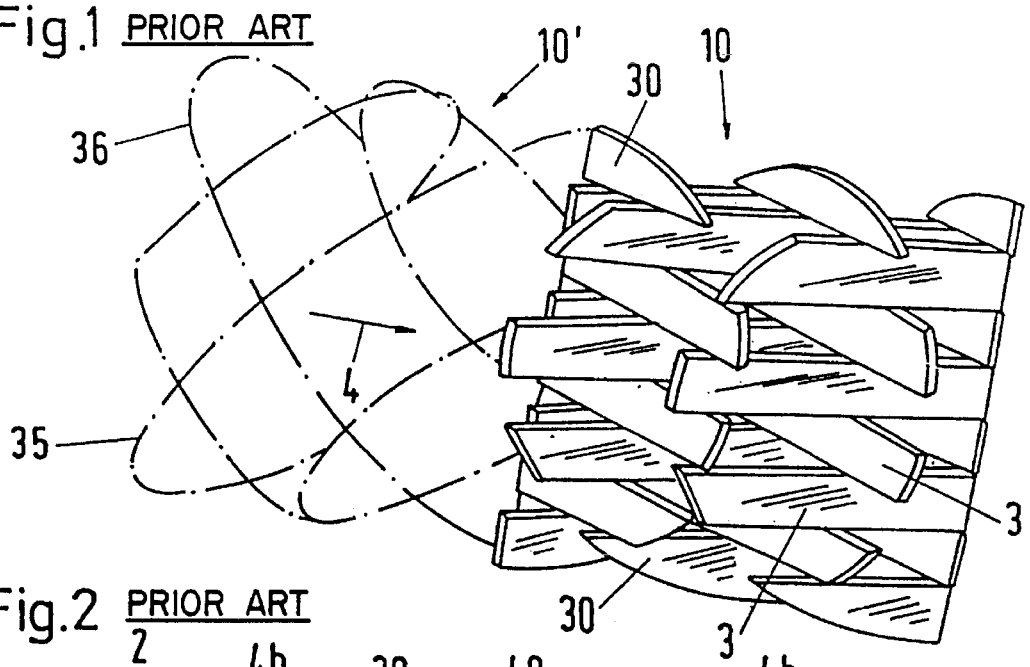
Fig.1 PRIOR ART
FIG. 1 illustrates a known mixer of the prior art in perspective section.

The mixer element 10 of FIG. 1 is comprised of criss-crossing webs 3 and 30. The reference numeral 30 is associated with the webs positioned at the edges. A neighbouring mixer element 10' is indicated with the dot-dashed lines. The elliptical lines 35 and 36 define the edges of surfaces which are held by webs (not-shown). The surfaces with the edges 35 and 36 cross one another. The two mixer elements 10 and 10' are the same but are arranged rotated relative to one another about the longitudinal axis by 90°. A longitudinal axis extends in the direction of the arrow 4 indicating the principal flow direction.

Figure 2:
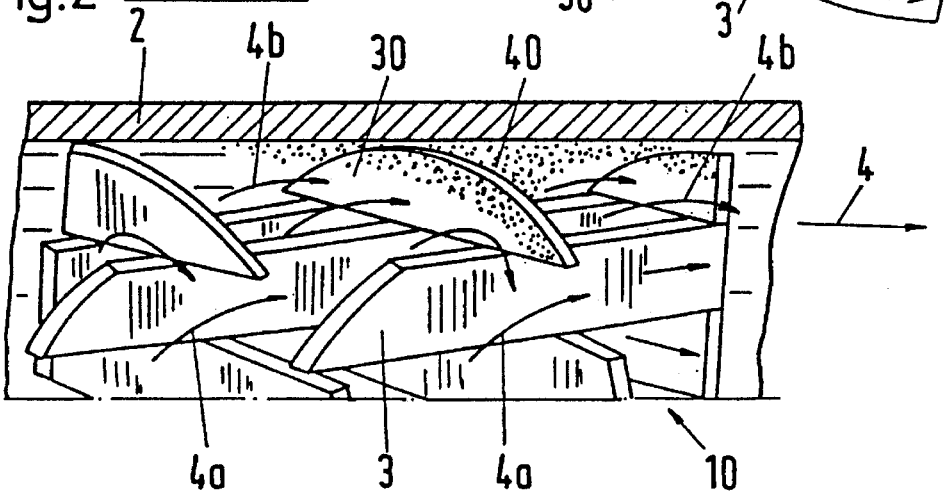
Fig.2 PRIOR ART
FIG. 2 illustrates the edge zone of a prior art mixer according to FIG. 1, with the individual flow behavior indicated by shading.

FIG. 2 shows the critical regions between the webs 30 positioned at the outer margins and the pipe wall 2. The weak flow in the edge regions is illustrated by the thin arrows 4*b* whereas the thick arrows 4*a* show the stronger current in the interior of the mixer element 10. The movement of the medium to be mixed practically comes to a stand still in the corner regions 40 between pipe wall 2 and webs 30 positioned at the outer margins, with the corner regions being marked in FIG. 2 by a plurality of points.

If, in accordance with the invention, the webs 30 positioned at the outer margins are omitted, then two segment-shaped open edge regions arise between the side edges of the lateral webs 31 (see FIG. 3) and the pipe wall 2. As a result of the segment-shaped edge regions, the medium can flow through axially without restriction. As has been shown experimentally, this measure does not have any significant effect in relation to the quality of the mixing.

Figure 3:
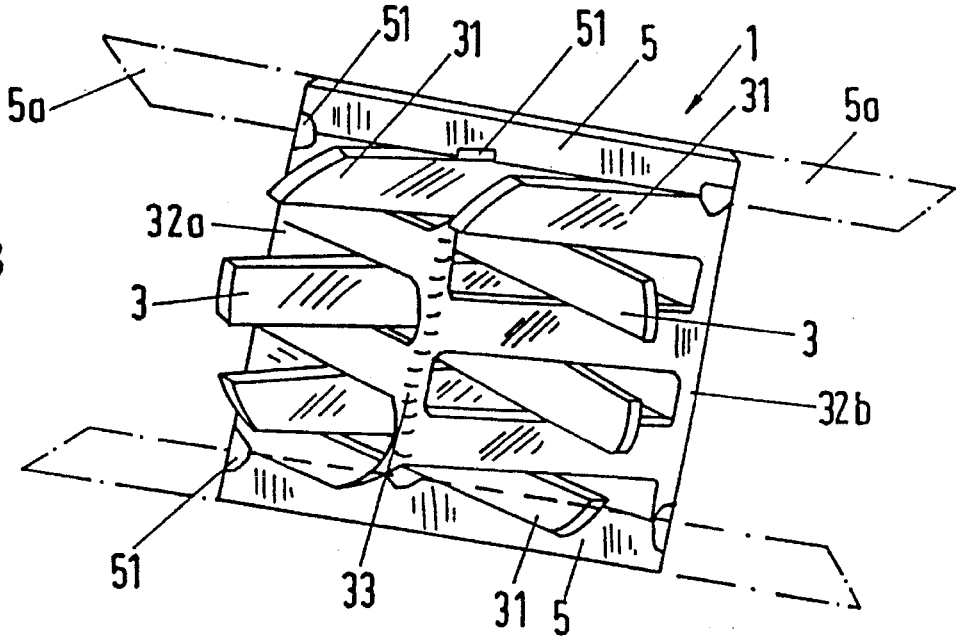
FIG. 3 illustrates a mixer element of the invention herein, arrived at by the modification of the mixer element of FIG. 1.
Figure 4:
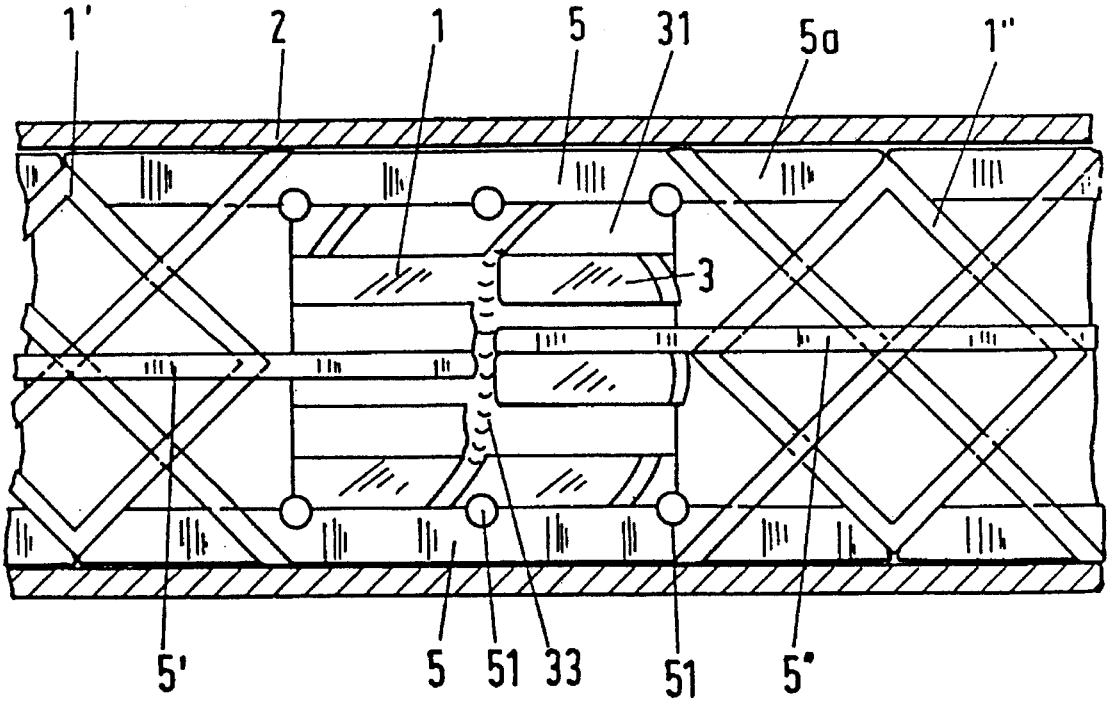
FIG. 4 illustrates a side view of the mixer elements of this invention, arranged in series.
Figure 5A:
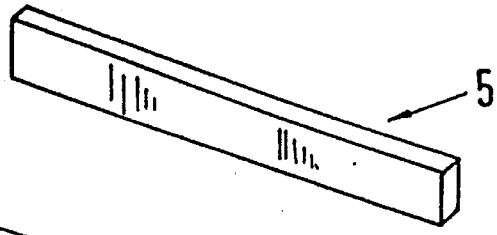
FIGS. 5*a* and 5*b* are respective illustrations of reinforcing ribs that can be used with this invention.
Figure 5B:
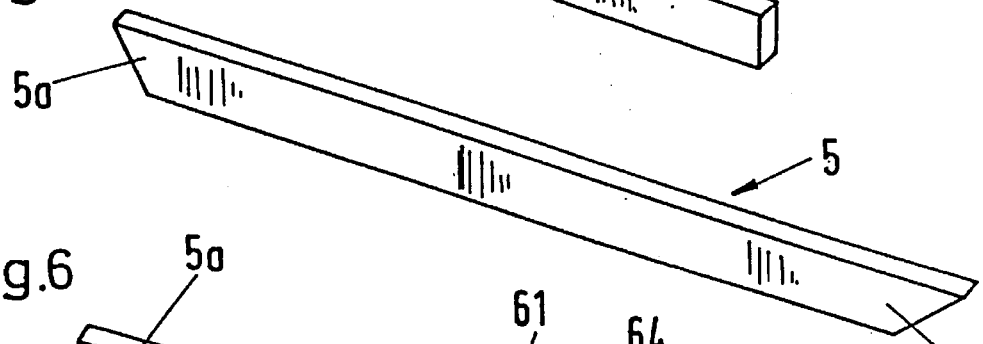

In the mixer element 1 of FIG. 3, the webs 30 positioned at the outer margins are removed and replaced by ribs 5. The ribs 5 give the mixer element 1 a reinforcement in the axial direction. The reinforcing ribs 5 can have just the length of the mixer element 1 (shown with the continuous line) or they can have extensions 5*a* (indicated by dot-dashed lines) which extend into the neighbouring mixer elements 1' and 1". The second case is illustrated in FIG. 4 where two neighbouring mixer elements 1' and 1" (with the associated reinforcing ribs 5' and 5") can be seen alongside the mixer element 1 of FIG. 3. In FIGS. 5*a* and 5*b*, the ribs 5, as provided in the mixer elements of FIG. 3 and 4 respectively, are shown as individual parts. The ribs 5 are connected at the points 51 with the lateral webs 31 (welded in the present case). The ribs 5 can also be formed in the shape of continuous beams extending over the whole length of the mixer apparatus.

In the embodiment shown, all webs 3, 31 of the mixer element 1 are of the same width. The separation between the lateral webs 31 and the pipe wall 2 in the two segment-shaped edge regions is not larger than one web width.

Advantageously, the intersection lines 32*a* and 32*b* defined by the crossing positions of the webs 3 and 31 (see FIG. 1) are ground to a wedge-shape (see FIG. 3). Thanks to this wedge-shape, a somewhat smaller pressure gradient results during the mixing process. The webs 3 and 31 are also advantageously separated into sections at the lateral intersection lines 33 and connected to one another by a weld joint. The reason for this measure is the same as for the omission of the webs 30 positioned at the outer margins. Modification at the lateral intersection lines 33 has the additional effect that the pressure gradient is further reduced. A disadvantageous effect on the quality of mixing is not present in practice.

Figure 6:
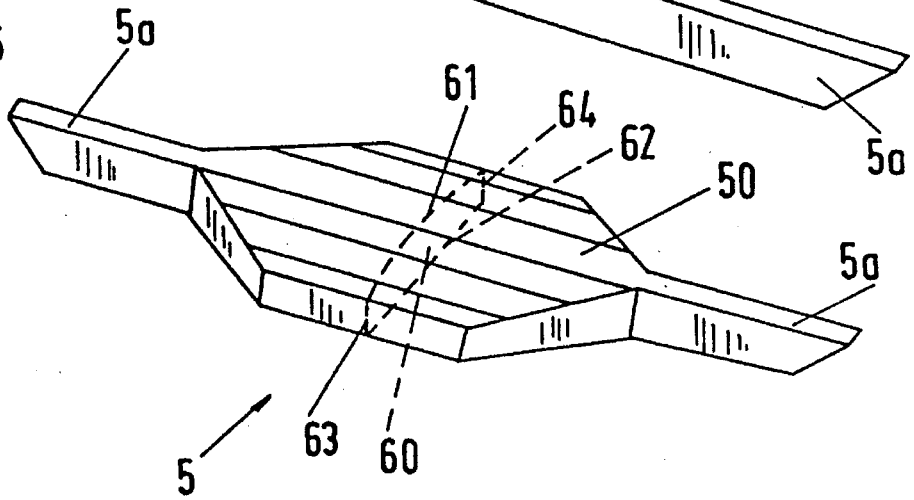
FIG. 6 is a perspective view of an expanded rib element utilized with this invention.

Further possibilities exist for the formation of the reinforcing ribs 5. An example shown in FIG. 6 in which the rib 5 has an expanded transverse portion 50 at its centre. The cross-section of this transverse portion 50 fills out a sector 50 of the segment-shaped edge or marginal region between the mixer element 1 and the tube 2 (see FIG. 4). The sector 60 is bounded in this case by an arc 61 of the pipe wall, by a portion 62 of the lateral surface of the mixer element 1 as well as by two connector portions 63 and 64. The height of the sector 60, measured perpendicular to the lateral surface of the mixer element 1 held by the lateral webs 31 is smaller than the width of the sector (=length of the portion 62).

The mixer element 1 shown in the drawing is provided for a tube 2 of circular cross-section. Naturally, the invention can be correspondingly provided also for a mixer apparatus with different cross-sectional forms. The invention is also applicable to an apparatus disclosed in Australian Publication No. 947 6900 (=P.6600) in which the mixer element has a flange-like ring. The mixer element—including the reinforcing ribs—can be provided also as a cast piece instead of in the form of a welded construction.

I claim:

1. In a static mixing device for highly viscous media including a conduit and a static mixer comprising:

a tubular casing defined about an axis of fluid flow for fluid to be mixed by the static mixer;

at least one static mixer element having first crossed webs and second crossed webs, each crossed web being disposed at a different angle other than normal or parallel to the axis of fluid flow and including individual spaced apart linear web elements defining fluid flow intervals there between;

the individual spaced apart linear web elements of any crossed web extending substantially parallel to one another and extending in side-by-side relation across substantially the width of the tubular casing and the individual spaced apart linear web elements of the first crossed webs angularly intersecting, crossing and occupying a portion of the fluid flow intervals of the individual spaced apart linear web elements of the second crossed webs;

the individual spaced apart linear web elements having a border at their respective ends to the tubular casing only; and, no individual spaced apart linear web elements having a border with the tubular casing continuously between their respective ends to the tubular casing whereby each individual spaced apart linear web element has a border at one end to the tubular casing, a boarder at an opposite end to the tubular casing, but lacks a direct border between the respective ends to the tubular casing to permit fluid flow between the individual spaced apart linear web elements and the tubular casing.

2. In a static mixing device for highly viscous media including a conduit and a static mixer according to claim 1 and further comprising:

all individual spaced apart linear web elements having a similar width.

3. In a static mixing device for highly viscous media including a conduit and a static mixer according to claim 1 and further comprising:

the individual spaced apart linear web elements immediately adjacent the tubular casing have a spacing from the tubular casing not larger than one web width.

4. In a static mixing device for highly viscous media including a conduit and a static mixer according to claim 1 and further comprising:

a rib disposed substantially parallel to the axis of fluid flow is disposed adjacent an edge of the tubular casing and is secured to the at least one static mixer element to reinforce the static mixer element.

5. In a static mixing device for highly viscous media including a conduit and a static mixer according to claim 1 and further comprising:

including a plurality of static mixer elements.

6. In a static mixing device for highly viscous media including a conduit and a static mixer according to claim 1 and further comprising:

a plurality of static mixer elements; and, a rib disposed substantially parallel to the axis of fluid flow is disposed adjacent an edge of the tubular casing and is secured to at least one of said static mixer elements to reinforce the one static mixer element and extends to the vicinity of an adjacent static mixer element.

7. In a static mixing device for highly viscous media including a conduit and a static mixer according to claim 6 and further comprising:

the rib having an expanded central portion bounded by the tubular casing on one side of the expanded central portion and by a portion of a lateral surface of the mixer element on the opposite side with two connector portions extending therebetween.

8. In a static mixing device for highly viscous media including a conduit and a static mixer according to claim 7 and further comprising:

a height of the rib of the expanded central portion between the tubular casing on one side and a portion of the lateral surface of the mixer element on the opposite side is smaller than the width between individual web elements.

* * * * *